US006234673B1

(12) United States Patent
Tonoff

(10) Patent No.: US 6,234,673 B1
(45) Date of Patent: May 22, 2001

(54) TOTAL VALUE PACKAGE

(76) Inventor: Boris M. Tonoff, 412 S. Arnaz Dr. #102, Los Angeles, CA (US) 90048

( * ) Notice: Subject to any disclaimer, the term of this patent is extended or adjusted under 35 U.S.C. 154(b) by 0 days.

(21) Appl. No.: 09/519,826

(22) Filed: Mar. 6, 2000

(51) Int. Cl.[7] ..... B65D 33/14

(52) U.S. Cl. ..... 383/9; 206/806; 383/61; 383/67; 383/204; 383/127

(58) Field of Search ..... 383/9, 204, 61, 383/67, 127; 206/806

(56) References Cited

U.S. PATENT DOCUMENTS 2,983,087 * 5/1961 Schofield ..... 383/9
3,024,962 * 3/1962 Meister ..... 206/806
3,285,497 * 11/1966 Stillman et al. ..... 383/9
3,289,386 * 12/1966 Farmer ..... 383/127
3,744,383 * 7/1973 Finch et al. ..... 383/127
4,986,673 * 1/1991 Bell ..... 383/61
5,456,928 * 10/1995 Hustad et al. ..... 383/61
5,924,795 * 7/1999 Thompson et al. ..... 383/61

* cited by examiner

*Primary Examiner*—Stephen P. Garbe
(74) *Attorney, Agent, or Firm*—Erik M. Arnhem

(57) ABSTRACT

A plastic bag for consumable products can include a flat tubular pouch having a contents information label at one end, and two separate seals at the other end. One of the seals is a tear-off seal that provides assurance that the bag is tamper-free. The other seal is a closure zipper that can be opened and closed a number of times, so that the user can consume part of the product at one time, and reseal the remaining product in the bag for later consumption.

2 Claims, 2 Drawing Sheets

TOTAL VALUE PACKAGE

BACKGROUND AND SUMMARY OF THE INVENTION

This invention relates to a total value pouch that incorporates an advertising label (or header) at one end, and two seals at the other end. One of the seals is a tear-off seal that may seal the package against tampering. The other seal is a zipper seal that can be opened and closed during normal usage of the pouch. The package (or pouch) would normally be used for displaying and marketing a range of consumable products, such as potato chips, pretzels, cookies, candy, crackers and nuts.

Prior art packages, or pouches, usually have an advertising header, or label, at the top end of the pouch; the bottom end of the pouch is permanently sealed. The prior pouch is opened by tearing off the top label to form an access opening at the top end of the pouch. This is disadvantageous in that the access opening cannot be resealed. If the person intends to delay the consumption of a portion of the product, the product will inevitably lose its freshness. Also, the product cannot be easily retained in the pouch, since the access opening forms an easy escape path for the product, especially if the pouch should be overturned or moved during storage.

The present invention concerns a reclosable bag that includes a flat tubular pouch formed of a flexible transparent plastic material, whereby a consumable product within the pouch can be visually displayed, e.g. in a vending machine or on a display rack in a drug store or grocery store. The upper end of the pouch is closed by an opaque lable, or header, that has product information thereon, e.g. tradename, picture, product name, weight and nutritional information.

The lower end of the pouch has a first tear-off seal and a second zipper seal that can be opened and closed repeatedly after the tear-off seal has been removed, i.e. torn away from the pouch lower end. The tear-off seal seals the product in the pouch during shipment and package display periods, such that the end user is assured that the product is safe for consumption. The zipper seal enables the end user to consume a portion of the product, and to retain the remaining portion in a relatively fresh condition in the pouch for consumption at a later time. The pouch can be stored in a cupboard or on a shelf for prolonged periods, so that the product can be consumed whenever desired.

Specific features of the invention will be apparent from the attached drawings and description of an illustrative embodiment of the invention.

DESCRIPTION OF A PREFERRED EMBODIMENT OF THE INVENTION

Figure 1:
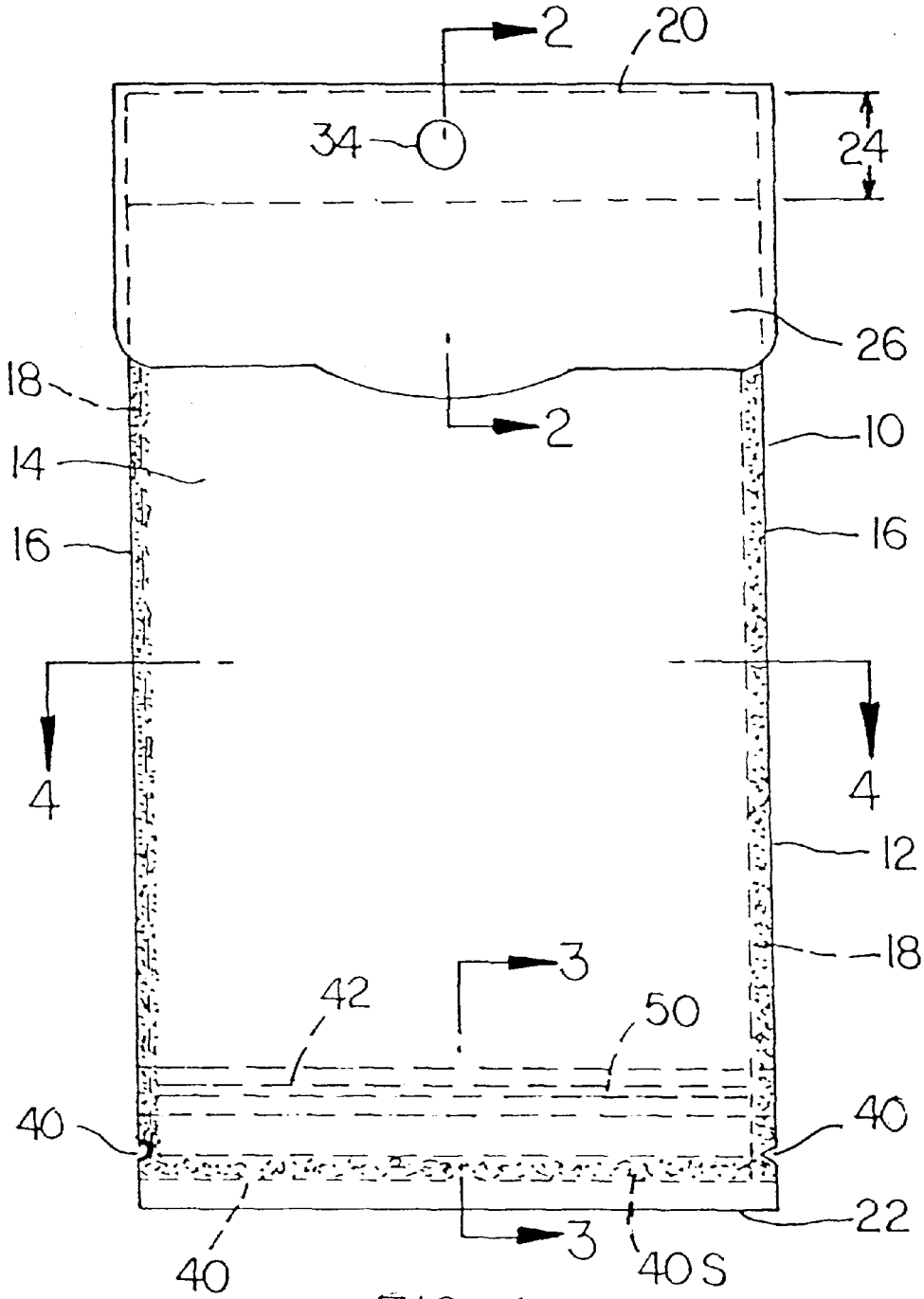
FIG. 1 is a plan view of a reclosable bag constructed according to the invention.
Figure 4:
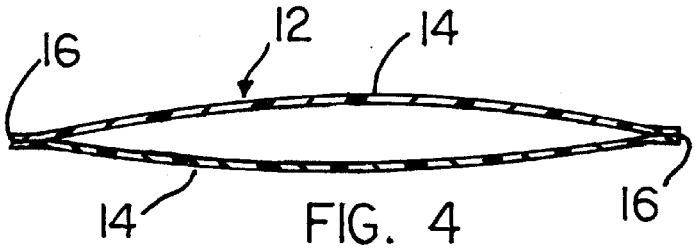
FIG. 4 is a transverse sectional view taken on line 4—4 in FIG. 1.

Referring to FIG. 1, there is shown a reclosable bag 10 that includes a flat tubular pouch 12 formed of a transparent flexible plastic material, having a preferred wall thickness of about 0.004 inch. As shown in FIG. 4, the pouch has two major walls 14, 14 and may be sealed together along their mating longitudinal edges 16, 16. The seal can be achieved by adhesives, or by heat and pressure, e.g. by heated rollers. In FIG. 1, the sealed edge surfaces are designated by numerals 18. The sealed edges extend the entire length of the tubular pouch, from top end 20 to bottom end 22.

Figure 2:
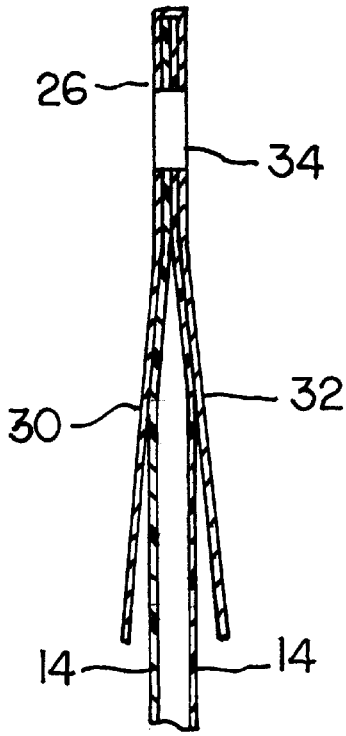
FIG. 2 is an enlarged fragmentary sectional view taken on line 2—2 in FIG. 1.

Top end 20 of the tubular pouch is closed permanently by heat sealing upper mating surfaces of walls 14, 14. In FIG. 1, the sealed surface area is denoted by numeral 24. Additionally the top end of the pouch serves as a mounting area for a contents-information label 26, preferably formed of a semi-flexible plastic, or cardboard. As shown in FIG. 2, label 26 is folded around the extreme upper edge of the pouch, to form a sheet section 30 facing leftwardly, and a second sheet section 32 facing rightwardly. Product information is provided on each sheet section, so that a person viewing the bag on a display rack or in a vending machine can select, or not select, the bag. Such product information can include various advertising information, e.g. product name, tradename, size or weight of the product, ingredients, and nutritional information. Label 26 can be secured to the upper end of bag 10 by various means, e.g. adhesives, staples, or heat (fusion). The lower end areas of the label are usually separated from the bag, as shown in FIG. 2. A circular hole 34 is punched through label 26 and the enclosed areas of the pouch, to enable the bag to be suspended from a rod or hook, not shown.

The lower end of tubular pouch 12 is closed by two separate seals, i.e. a tear-off seal 40 at (or near) end 22, and a zipper closure seal 42 spaced a short distance above seal 40.

Seal 40 can be formed by an adhesive, or by the use of heated bars (or platens) pressed against the outer surfaces of plastic walls 14, 14. In FIG. 1 the seal 40 area is designated by numeral 40 S. The seal can be formed at ends 22 of the pouch major walls, or spaced a relatively short distance from ends 22, as shown in FIG. 1.

Seal 40 can be broken by grasping the lower end of the pouch at one corner and tearing the pouch walls 12, 12 as a unit transversely toward the other adjacent corner of the pouch. Notches are preformed in edge areas of the pouch on an imaginary line running along the upper limit of seal area 40 S. These notches form starting points for the tear-off action, so that when the seal area is torn away, the newly-formed lower edge of the pouch will extend transversely across the pouch, from one notch to the other notch.

The second seal for the lower end of the pouch is a zipper closure 42 that can be opened or closed repeatedly after seal 40 has been torn away from the lower end of the pouch. Zipper closure 42 includes a first plastic tape 46 spanning the pouch side edges along the inner surface of one of pouch major walls, and a second plastic tape 48 spanning the pouch side edges along the inner surface of the other pouch major wall. The tapes can be attached to the respective pouch walls prior to the process of fabricating the pouch. Heat or suitable adhesives can be used for attachment of the tapes.

Figure 3:
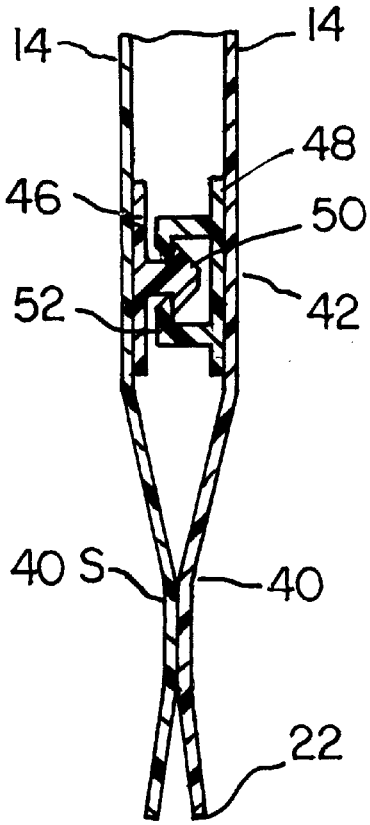
FIG. 3 is a fragmentary enlarged sectional view taken on line 3—3 in FIG. 1.

Tape 46 is extruded so that a male closure element 50 is formed by the extrusion process. Tape 48 is extruded so that a female closure element 52 is formed. FIG. 3 shows the two closure elements 50 and 52 interlocked together to form a seal between the major walls of the pouch. The tapes can be pulled apart to gain access to the pouch (after seal 40 has been torn away from the pouch).

During the process of compressing edge areas 16 of walls together (to form the edge seals), the ends of tapes 46 and

48 will be flattened to form stops for limiting any separation of the interlocking closure elements 50 and 52 during normal use of bag 10.

Zipper closure 42 and tear-off seal 40 form a principal feature of the invention. Seal 40 can be torn off the pouch without disturbing label 26 or the suspension hole 34. The label remains intact so that information on the label is available for reference after the bag has been initially opened. Label 26 remains on the bag during the normal use of the bag, i.e. from initial purchase to final disposal of the bag.

Seal 40 gives the customer an assurance that the bag has not been tampered with, i.e. that nothing has been taken out of the bag or added to the bag, after the initial packaging operation at the factory.

Zipper closure 42 enables the end user to open and close the bag any number of times, such that the user can consume part of the bag contents, and reseal the remaining product in the bag for later consumption. Closure 42 maintains the bag contents in a near-fresh condition for a prolonged time period.

The invention can be used on bags designed to contain various products, e.g. vegetables, cheese, candy, cookies, etc. The bag size can vary according to the nature and quantity of product being marketed.

What is claimed is:

1. A reclosable bag comprising:

a flat tubular pouch formed of a flexible transparent plastic material; said pouch having two opposed major walls that are connected to form two longitudinal side edges;

said pouch having first and second ends:

a contents-information label extending across said first end of said pouch; said label comprising an informational sheet folded along said first end of the pouch to provide two sheet sections facing in opposite directions outside the major walls of said pouch; said pouch major walls being permanently sealed together at said first end of the pouch, whereby said label can remain intact during the service life of the bag;

a tear-off seal closing said second end of said pouch;

an openable zipper closure proximate to said seal near said second end of the pouch; whereby the pouch can be opened and closed after said tear-off seal has been torn from said second end of the tubular pouch; and a bag-suspension hole (34) extending through said sheet sections of the label and the associated pouch walls; said hole being of sufficient size to fit onto a suspension rod in a vending machine or display rack.

2. A reclosable bag comprising:

a tubular pouch formed of a transparent flexible plastic material, said pouch having two opposed major walls that are connected to form two longitudinal side edges;

said pouch having first and second ends;

a contents-information label formed separately from said pouch; said contents-information label being secured to at least one of the major pouch walls at the first end of said pouch so as to substantially span the longitudinal side edges of the pouch; said pouch major walls being permanently sealed together at said first end of the pouch, whereby said label can remain intact during the service life of the bag;

a tear-off seal closing said second end of said pouch;

an openable zipper closure proximate to said seal proximate to said second end of the pouch, whereby the pouch can be opened and closed after said tear-off seal has been torn from said second end of the pouch; and a bag-suspension hole (34) extending through said label and the associated pouch walls; said hole being of sufficient size to fit onto a suspension rod in a vending machine or display rack.

* * * * *